US007341260B1

(12) United States Patent
Hosoda et al.

(10) Patent No.: US 7,341,260 B1
(45) Date of Patent: Mar. 11, 2008

(54) SKATEBOARD

(76) Inventors: Togo Hosoda, Bellpierchigasaki 101, 4-8-5 Higasikaiganminami, Chigasaki City, Kanagawa (JP); Chiung-Hsin Liu, 14F-1, No. 426, Chung-Hsiao E. Rd., Shi Chih City, Taipei (TW) 221

( * ) Notice: Subject to any disclaimer, the term of this patent is extended or adjusted under 35 U.S.C. 154(b) by 0 days.

(21) Appl. No.: 11/604,867

(22) Filed: Nov. 28, 2006

(51) Int. Cl.
*A63C 17/02* (2006.01)

(52) U.S. Cl. ..... 280/11.19; 280/11.28; 280/11.27; 280/11.225; 280/87.042

(58) Field of Classification Search ..... 280/11.28, 280/11.27, 11.225, 11.19, 87.042
See application file for complete search history.

(56) References Cited

U.S. PATENT DOCUMENTS 4,088,334 A * 5/1978 Johnson ..... 280/11.206
4,185,847 A * 1/1980 Johnson ..... 280/87.042
6,375,205 B1 * 4/2002 De Fontenay et al. .. 280/93.502
7,080,845 B2 * 7/2006 Inchley ..... 280/87.042
7,093,842 B2 * 8/2006 Chmelar ..... 280/87.042
7,159,879 B2 * 1/2007 Cole ..... 280/87.042

* cited by examiner

*Primary Examiner*—Christopher P. Ellis
*Assistant Examiner*—Cynthia F. Collado
(74) *Attorney, Agent, or Firm*—Rosenberg, Klein & Lee

(57) ABSTRACT

A truck includes a chassis attached to a deck of the skateboard, a yoke pivotally connected to the chassis and two wheels provided on the yoke. The chassis includes a rod extended from the underside thereof. The yoke includes a first portion, a second portion extended from the first portion, a third portion extended from the second portion so that the first and third portions thereof are biased and a rod extended from the upside of the first portion thereof. The wheels are provided on third portion of the yoke. A torque spring includes two ends located on opposite sides of the rods. One of the ends of the torque spring engages with the rod of the chassis while the remaining end of the torque spring engages with the rod of the yoke. Thus, the torque spring is loaded and tends to return the yoke relative to the chassis.

9 Claims, 3 Drawing Sheets

SKATEBOARD

BACKGROUND OF INVENTION

1. Field of Invention

The present invention relates to a skateboard and, more particularly, to a truck for a skateboard.

2. Related Prior Art

There have been devised various trucks for skateboards such as those described in U.S. Pat. Nos. 7,080,845 and 7,093,842. These trucks are intended to provide excellent steering without suffering the jam of the wheels. These attempts are however unsatisfactory.

The present invention is therefore intended to obviate or at least alleviate the problems encountered in prior art.

SUMMARY OF INVENTION

It is the primary objective of the present invention to provide a truck for a skateboard capable of excellent steering without suffering the jam of the wheels thereof.

According to the present invention, a truck includes a chassis attached to a deck of a skateboard, a yoke pivotally connected to the chassis and two wheels provided on the yoke. The chassis includes a rod extended from the underside thereof. The yoke includes a first portion, a second portion extended from the first portion, a third portion extended from the second portion so that the first and third portions thereof are biased and a rod extended from the upside of the first portion thereof. The wheels are provided on third portion of the yoke. A torque spring includes two ends located on opposite sides of the rods. One of the ends of the torque spring engages with the rod of the chassis while the remaining end of the torque spring engages with the rod of the yoke. Thus, the torque spring is loaded and tends to return the yoke relative to the chassis.

Other objectives and features of the present invention will become apparent from the following description referring to the drawings.

BRIEF DESCRIPTION OF DRAWINGS

The present invention will be described through the illustration of the preferred embodiment referring to the drawings.

DETAILED DESCRIPTION OF PREFERRED EMBODIMENT

Figure 1:
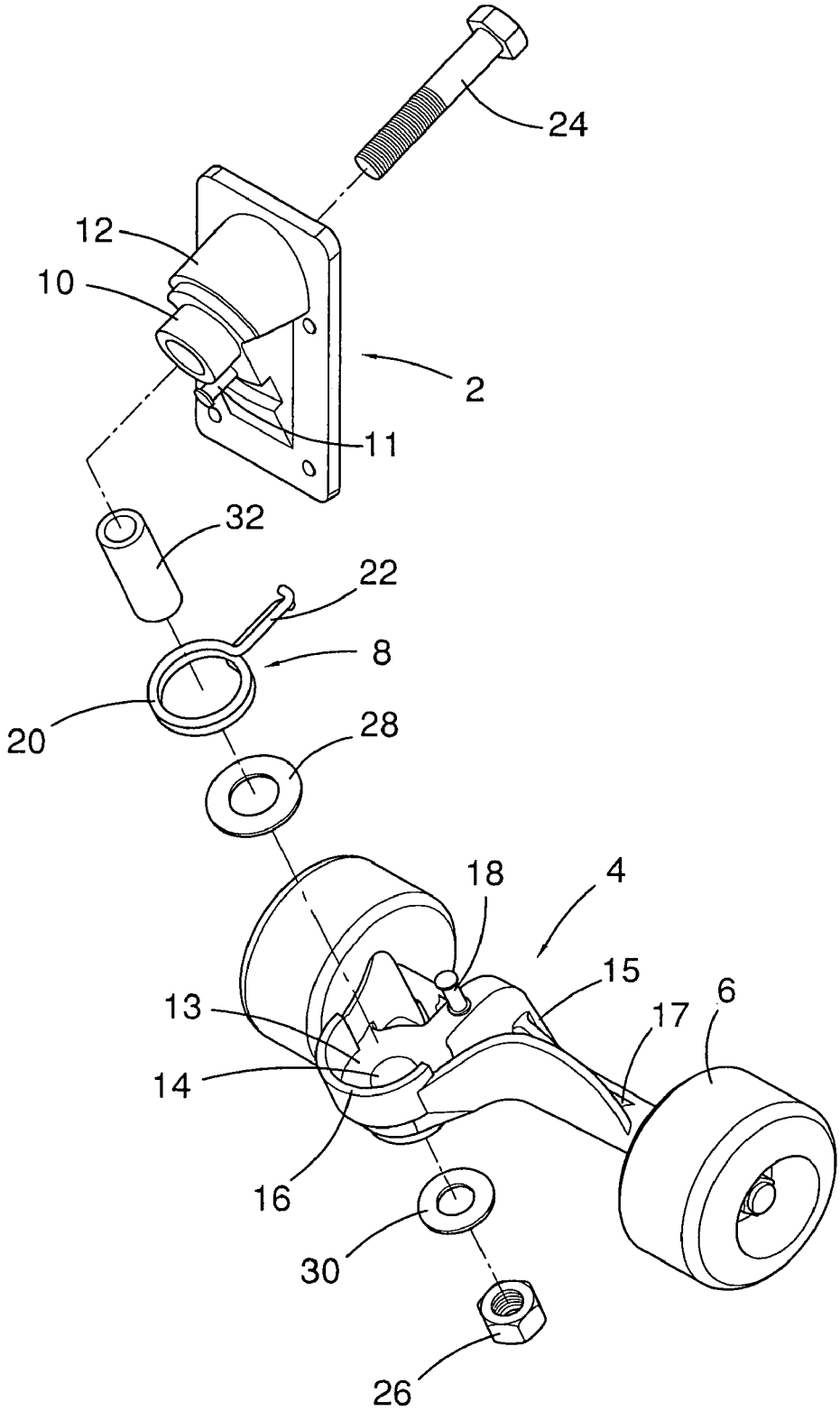
FIG. 1 is an exploded view of a truck for a skateboard according to the preferred embodiment of the present invention.

Referring to FIG. 1, there is shown a truck for a skateboard according to the preferred embodiment of the present invention. The truck includes a chassis 2 attached to the underside of a deck of the skateboard, a yoke 4 pivotally connected to the chassis 2, two wheels 6 provided on the yoke 4 and a torque spring 8 provided between the chassis 2 and the yoke 4.

The chassis 2 includes a tube 10 extended from the underside thereof, an arched block 12 formed around the tube 10 and a rod 11 extended from the underside thereof.

The yoke 4 is formed with a first portion 13, a second portion 15 extended from the first portion 13 substantially at the right angle and a third portion 17 extended from the second portion 15 substantially at the right angle. Thus, the axis of the first portion 13 of the yoke 4 is biased from the axis of the third portion 17 of the yoke 4. The first portion 13 of the yoke 4 is hub defining an aperture 14. An arched wall 16 and a rod 18 are formed on the upper side of the first portion 13 of the yoke 4. The arched wall 16 is formed around the aperture 14. The wheels 6 are provided on two opposite sides of the third portion 17 of the yoke 4.

The torque spring 8 includes a helical portion 20 and two hooks 22 extended from the helical portion 20. The hooks 22 cross each other.

A threaded bolt 24 and a nut 26 are used to join the chassis 2, the yoke 4 and the torque spring 8 to each other. Washers 28 and 30 may be used to ensure firm engagement of the threaded bolt 24 with the nut 26. A bush 32 may be used to ensure smooth pivoting of the yoke 4 relative to the chassis 2.

Figure 2:
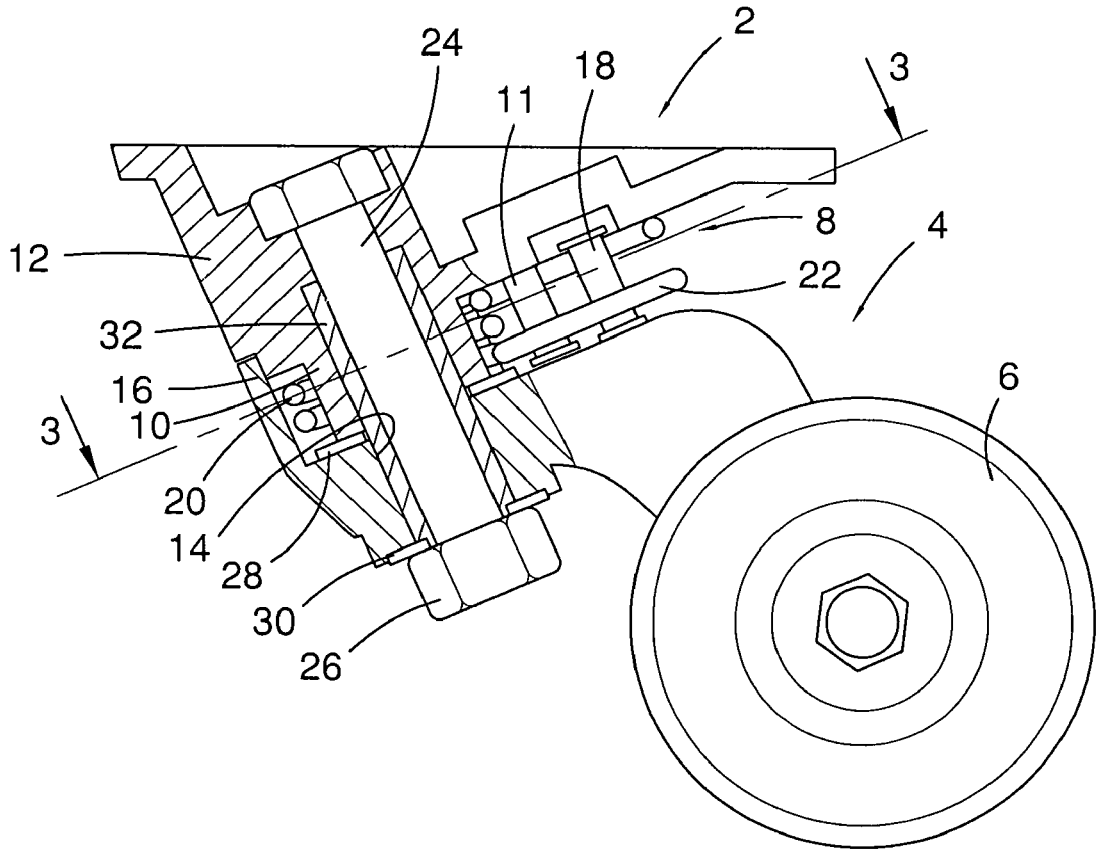
FIG. 2 is a cross-sectional view of the truck shown in FIG. 1.
Figure 3:
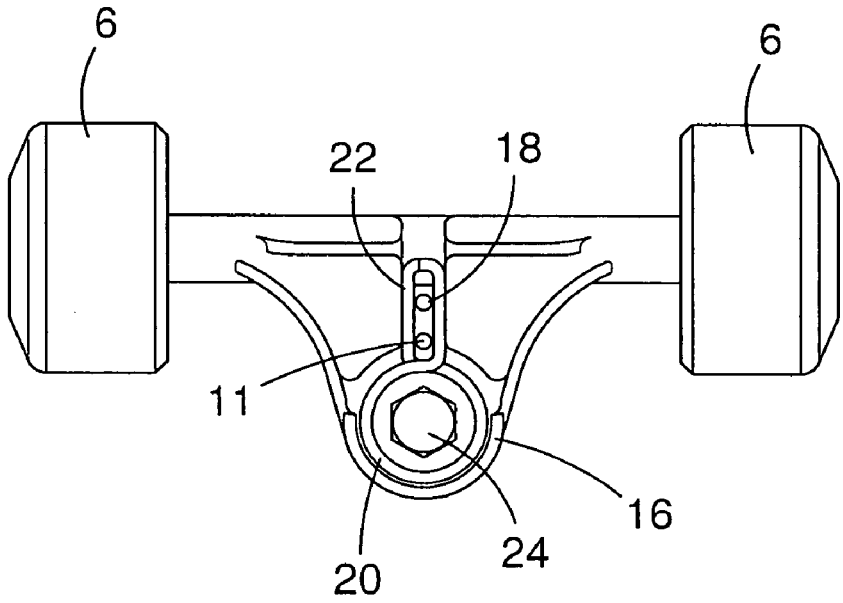
FIG. 3 is a cross-sectional view of the truck taken along a line 3-3 shown in FIG. 2.

Referring to FIGS. 2 and 3, the washer 28 is located on the upside of the yoke 4 while the washer 30 is located on the underside of the yoke 4. The torque spring 8 is mounted on the upside of the yoke 4, with the hooks 22 located on opposite sides of the rods 11 and 18. The bush 32 is inserted in the aperture 14. The chassis 2 is mounted on the upside of the yoke 4. The tube 10 is inserted in the helical portion 20 of the torque spring 8. The bush 32 is inserted in the tube 10. The arched block 12 is guided by the arched wall 16 for ensuring the smooth pivoting of yoke 4 relative to the chassis 2. The threaded bolt 24 is inserted in the tube 10, the bush 32 and the aperture 14 and engaged with the nut 26.

Figure 4:
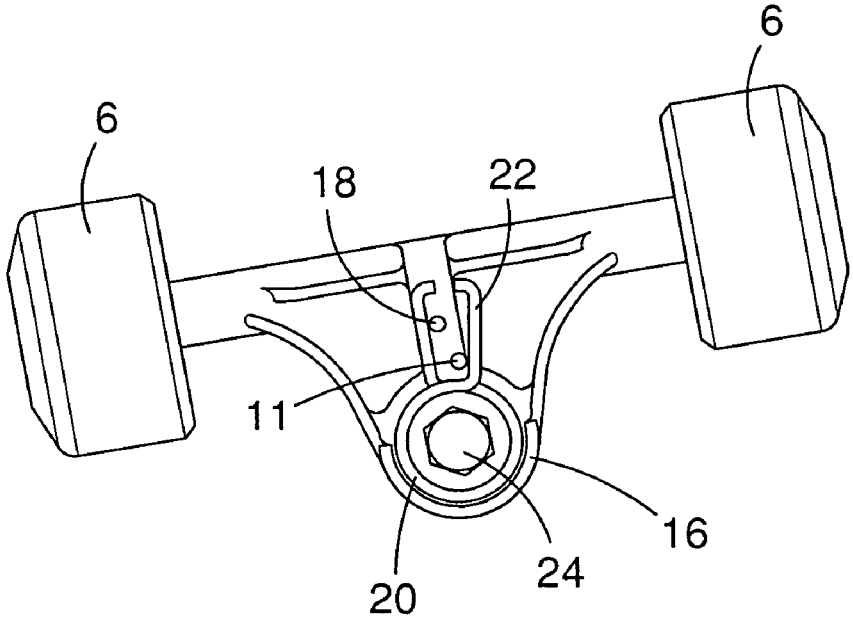
FIG. 4 is a cross-sectional view of the truck in another position other than shown in FIG. 3.

Referring to FIG. 4, as the yoke 4 is pivoted relative to the chassis 2 in a direction, one of the hooks 22 of the torque spring 8 engages with the rod 11 while the remaining hook 22 of the torque spring 8 engages with the rod 18. Thus, the torque spring 8 is loaded and therefore tends to return the yoke 4 to the original position relative to chassis 2 for helping a player maneuver the skateboard. As the hooks 22 of the torque spring 8 cross each other, the helical portion 20 of the torque spring 8 contracts.

The axis of the rotation of the first portion 13 of the yoke 14 is not particular to a plane in which the deck lies. The axis of the rotation of the first portion 13 of the yoke 14 and the axis of the rotation of the wheels 6 are staggered. Thus, the skateboard can be steered to a large extent but laterally tilted to a small extent. That is, the skateboard can readily be steered while the wheels 6 will not be jammed by the deck.

The primary advantage of the skateboard of the present invention is to allow excellent steering without suffering the jam of the wheels.

The present invention has been described via the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A truck for a skateboard comprising:

a chassis for attachment to a deck of the skateboard, the chassis comprising a rod extended from the underside thereof;

a yoke pivotally connected to the chassis, the yoke comprising a first portion, a second portion extended from the first portion, a third portion extended from the second portion so that the first and third portions thereof are biased and a rod extended from the upside of the first portion thereof;

two wheels provided on third portion of the yoke; and a torque spring comprising two ends located on opposite sides of the rods so that one of the ends of the torque spring engages with the rod of the chassis while the remaining end of the torque spring engages with the rod of the yoke, thus loading the torque spring that tends to return the yoke relative to the chassis.

2. The truck according to claim 1 wherein each of the ends of the torque spring is formed as a hook.

3. The truck according to claim 1 wherein the torque spring comprises a helical portion from which the ends are extended.

4. The truck according to claim 3 wherein the chassis comprises a tube extended from the underside thereof and inserted in the helical portion of the torque spring.

5. The truck according to claim 1 wherein the chassis comprises an arched block formed on the underside thereof, and the yoke comprises an arched wall raised from the upside thereof for guiding the arched block.

6. The truck according to claim 1 comprising a threaded bolt and a nut for pivotally connecting the yoke to the chassis.

7. The truck according to claim 6 wherein the chassis comprises a tube for receiving the threaded bolt, and the yoke defines an aperture for receiving the threaded bolt.

8. The truck according to claim 7 wherein the torque spring comprises a helical portion provided around the tube.

9. The truck according to claim 7 comprising a bush inserted in the tube at an end, inserted in the aperture at another end and provided around the threaded bolt.

* * * * *